US006715244B2

(12) United States Patent
Boone et al.

(10) Patent No.: US 6,715,244 B2
(45) Date of Patent: Apr. 6, 2004

(54) MULTI-SHEET GLAZING UNIT AND METHOD OF MAKING SAME

(75) Inventors: Bradley P. Boone, Pittsburgh, PA (US); Stephen L. Crandell, Cranberry Township, PA (US); Jack B. McCandless, Natrona Heights, PA (US); David E. Singleton, Natrona Heights, PA (US); Albert E. Thompson, Jr., New Kensington, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 10/277,690

(22) Filed: Oct. 22, 2002

(65) Prior Publication Data

US 2003/0033761 A1 Feb. 20, 2003

Related U.S. Application Data

(60) Division of application No. 09/990,727, filed on Nov. 21, 2001, now Pat. No. 6,477,812, which is a division of application No. 09/499,145, filed on Feb. 7, 2000, now Pat. No. 6,345,485, which is a division of application No. 09/078,785, filed on May 14, 1998, now Pat. No. 6,115,989, which is a continuation-in-part of application No. 09/016,536, filed on Jan. 30, 1998, now Pat. No. 6,250,026, which is a continuation-in-part of application No. 09/016,535, filed on Jan. 30, 1998, now Pat. No. 6,289,641.

(51) Int. Cl.[7] ..... E06B 7/00

(52) U.S. Cl. ..... 52/204.591; 52/204.593; 52/204.595; 52/786.13; 52/800.14

(58) Field of Search ..... 52/172, 204.591, 52/204.513, 204.593, 204.595, 786.13, 800.14, 204.62

(56) References Cited

U.S. PATENT DOCUMENTS 2,563,378 A * 8/1951 Schnee ..... 52/172

(List continued on next page.)

FOREIGN PATENT DOCUMENTS

CA 1165627 4/1984

(List continued on next page.)

OTHER PUBLICATIONS

Arasteh, D. et al., "The Design and Testing of a Highly Insulating Glazing System for Use With Conventional Window Systems", *Transactions of the ASME, Journal of Solar Energy Engineering,* Feb. 1989, vol. III, pp. 44–53.

(List continued on next page.)

*Primary Examiner*—Carl D. Friedman
*Assistant Examiner*—Chi Q. Nguyen
(74) *Attorney, Agent, or Firm*—Andrew C. Siminerio

(57) ABSTRACT

A multi-sheet glazing unit includes a closed spacer frame, the spacer frame has one side having a pair of legs joined to a base to provide the spacer frame with a U-shaped cross-section. An inner sheet has an edge mounted in an edge receiving member mounted between the legs of the U-shaped side of the spacer frame. The remaining edges of the inner sheet are within the interior of the closed spacer frame and spaced from the spacer frame. The inner sheet is held within the spacer frame by sheet retaining members mounted to the spacer frame. A sheet e.g. glass sheet is secured by a moisture-impervious adhesive to outer surface of each of the legs of the spacer frame. One type of sheet retaining members has a horizontal member and a vertical member, and a locking member. The locking member is mounted on the horizontal member spaced from the vertical member to form a groove to hold the inner sheet within the closed interior of the spacer frame. Another type of the sheet retaining member includes a pair of flexible fingers mounted on a platform member, angled away from the platform member toward one another and having their ends spaced from one another to provide a groove to hold the inner sheet within the closed interior of the spacer frame. A method for making the unit is also disclosed.

20 Claims, 6 Drawing Sheets

U.S. PATENT DOCUMENTS

| | | | | | |
|---|---|---|---|---|---|
| 2,641,031 | A | | 6/1953 | Ehret | |
| 2,934,800 | A | | 5/1960 | Hasbrouck et al. | |
| 3,040,847 | A | | 6/1962 | Webster | |
| 3,837,129 | A | | 9/1974 | Losell | |
| 4,055,031 | A | * | 10/1977 | Okawa et al. | 52/172 |
| 4,170,460 | A | | 10/1979 | Donley | |
| 4,239,816 | A | | 12/1980 | Breininger et al. | |
| 4,376,359 | A | | 3/1983 | Redman | |
| 4,462,884 | A | | 7/1984 | Gillery et al. | |
| 4,520,611 | A | | 6/1985 | Shingu et al. | |
| 4,610,711 | A | | 9/1986 | Matesa et al. | |
| 4,692,389 | A | | 9/1987 | Gillery et al. | |
| 4,703,598 | A | | 11/1987 | Wilson et al. | |
| 4,719,127 | A | | 1/1988 | Greenberg | |
| 4,792,536 | A | | 12/1988 | Pecoraro et al. | |
| 4,806,220 | A | | 2/1989 | Finley | |
| 4,853,256 | A | | 8/1989 | Obringer et al. | |
| 4,853,257 | A | | 8/1989 | Henery | |
| 4,873,206 | A | | 10/1989 | Jones | |
| 4,898,789 | A | | 2/1990 | Finley | |
| 4,899,507 | A | * | 2/1990 | Mairlot | 52/222 |
| 5,030,593 | A | | 7/1991 | Heithoff | |
| 5,177,916 | A | | 1/1993 | Misera et al. | |
| 5,240,886 | A | | 8/1993 | Gulotta et al. | |
| 5,313,761 | A | | 5/1994 | Leopold | |
| 5,356,718 | A | | 10/1994 | Athey et al. | |
| 5,377,473 | A | | 1/1995 | Narayan et al. | |
| 5,531,047 | A | | 7/1996 | Leopold et al. | |
| 5,553,440 | A | | 9/1996 | Bulger et al. | |
| 5,601,677 | A | | 2/1997 | Leopold | |
| 5,613,759 | A | * | 3/1997 | Ludwig et al. | 362/149 |
| 5,644,894 | A | * | 7/1997 | Hundson | 52/786.13 |
| 5,655,282 | A | | 8/1997 | Hodek et al. | |
| 5,678,377 | A | | 10/1997 | Leopold | |
| 6,055,783 | A | * | 5/2000 | Guhl et al. | 52/204.62 |
| 6,115,989 | A | | 9/2000 | Boone et al. | 52/786.13 |
| 6,250,026 | B1 | | 6/2001 | Thompson | 52/172 |
| 6,289,641 | B1 | | 9/2001 | McCandless | 52/172 |
| 6,345,485 | B1 | | 2/2002 | Boone et al. | 52/786.13 |
| 6,477,812 | B2 | | 11/2002 | Boone et al. | 52/172 |

FOREIGN PATENT DOCUMENTS

| | | |
|---|---|---|
| DE | 1908567 | 9/1969 |
| DE | 4226883 | 3/1993 |
| EP | 0 223 511 | 5/1987 |
| EP | 0 403 058 | 12/1990 |
| EP | 0 475 213 | 3/1992 |
| FR | 2350436 | 12/1977 |
| FR | 2492880 | 4/1982 |

OTHER PUBLICATIONS

Selkowitz, Stephen E. et al., United States Statutory Invention Registration No. H975, entitled "Thermal Insulated Glazing Unit", published Nov. 5, 1991.

* cited by examiner

MULTI-SHEET GLAZING UNIT AND METHOD OF MAKING SAME

RELATED APPLICATIONS

This is a divisional application of U.S. Ser. No. 09/990,727 filed on Nov. 21, 2001, in the names of Bradley P. Boone, Stephen L. Crandell, Jack B. McCandless, David E. Singleton and Albert E. Thompson, Jr., now U.S. Pat. No. 6,477,812B1, which is a divisional application of U.S. Ser. No. 09/499,145 filed on Feb. 7, 2000, in the names of Bradley P. Boone, Stephen L. Crandall, Jack B. McCandless, David E. Singleton and Albert E. Thompson. Jr., now U.S. Pat. No. 6,345,485B1, which is a divisional application of U.S. patent application Ser. No. 09/078,785 filed on May 14, 1998, in the names of Bradley P. Boone, Stephen L. Crandall, Jack B. Mocandless, David B. Singleton and Albert E. Thompson, Jr., now U.S. Pat. No. 6,115,989B1, which is a continuation-in-part application of U.S. patent application Ser. No. 09/016,536 filed Jan. 30,1998, in the name of Albert E. Thompson, Jr., now U.S. Pat. No. 6,250,026B1 and U.S. patent application Ser. No. 09/016,535 filed Jan. 30, 1998, in the name of Jack B. McCandless, now U.S. Pat. No. 6,289,641B1, U.S. Pat. No. 6,415,561B1issued on a divisional application of the application that issued as U.S. Pat. No. 6,250,026B1.

FIELD OF THE INVENTION

This invention relates to a multi-sheet glazing unit and, in particular, to a multi-sheet glazing unit having a pair of outer glass sheets separated by and secured to a spacer frame and one or more inner glass sheet(s) mounted between and spaced from the outer sheets to minimize if not eliminate gas movement around top and bottom edges of the inner sheets and to a method of making the multi-sheet glazing unit.

BACKGROUND OF THE INVENTION

European Patent Application Publication Number 0 475 213 A1 published Mar. 18, 1992 Bulletin 92/12 (hereinafter "EP Application") and U.S. Pat. No. 5,655,282 (hereinafter "U.S. Pat. No. '282") disclose a thermal insulating glazing unit having three or more sheets with a spacer frame between and adhered to adjacent glass sheets. This construction of a triple sheet glazed unit has, among other things, the advantage of dead air spaces between adjacent sheets. The dead air spaces eliminate gas movement or gas currents moving between the compartment between the middle sheet and one of the outer sheets (the "first compartment") and the compartment between the middle sheet and the other one of the other sheets (the "second compartment"). In the instance where there is gas movement between the first compartment and the second compartment, the gas in the first compartment is heated or cooled by the outer sheet of the first compartment and moves into the second compartment to heat or cool the other outer glass sheet. This gas movement between the compartments if present reduces the thermal insulating properties of the unit.

Although the design of the multi-sheet insulating unit disclosed in the EP application and U.S. Pat. No. '282 has dead gas spaces between adjacent sheets i.e. no gas movement between the compartments, the techniques for making the multi-sheet insulating unit have limitations. More particularly, a spacer frame is provided between adjacent glass sheets requiring the construction of two spacer frames for a unit having three sheets and three spacer frames for a unit having four sheets.

U.S. Pat. No. 5,531,047 (hereinafter "U.S. Pat. No. '047") discloses multi-sheet glazing units having one or more inner glass sheets spaced from and between a pair of outer glass sheets. In general, the outer glass sheets are separated by and secured to a spacer frame having a U-shaped cross section. On the base of the spacer frame between the outer legs is a layer of a pliable material having one or more groove(s) for receiving edge portions of the inner glass sheet(s). The unit of U.S. Pat. No. '047 is fabricated by positioning a spacer stock around edge portions of the inner sheet(s) while moving the edge portions of the inner sheet(s) into the groove(s) of the pliable material to position the inner sheet (s) within the spacer frame. After the inner sheet(s) is(are) within the spacer frame, the outer sheets are secured to the outer surfaces of the spacer frame by a moisture-impervious sealant. The design of this unit has the advantages of a dead gas space between adjacent sheets and only one spacer frame.

Although the design of the unit disclosed in U.S. Pat. No. '047 is acceptable, there are limitations. For example, moving the edge portions of the inner sheet(s) into the pliable material on the base of the spacer stock as the spacer stock is positioned around the inner sheet(s) requires time and precision. More particularly, positioning the spacer stock around the inner sheet(s) may disturb the pliable material on the base of the spacer frame, making the unit unsightly.

U.S. Pat. No. 5,644,894 (hereinafter "U.S. Pat. No. '894") discloses multi-sheet glazing units having one or more inner glass sheet(s) mounted within a U-shaped spacer frame and outer sheets adhered to outer surfaces of the spacer frame by a moisture-impervious sealant. The intermediate sheet(s) is(are) held in position by spaced rows of raised portions formed in the base of the spacer frame. The design of these units has the advantage of a dead gas space between adjacent sheets. Although the glazing unit design disclosed in U.S. Pat. No. '894 is acceptable, the fabrication of the unit has limitations. More particularly, providing spaced rows of raised portions in the base of the spacer frame requires an extra step in the process of making the spacer frame. Further, mounting the inner sheet(s) between raised portions as the spacer stock is wrapped around the inner sheet requires time and precision.

U.S. Pat. No. 5,553,440 (hereinafter "U.S. Pat. No. '440") also discloses multi-sheet glazing units having three or more glass sheets. In general, the units include a pair of outer glass sheets separated by and adhered to outer opposed surfaces of a spacer frame having a U-shaped cross-section. A sheet retaining member mounted between the upright legs of the spacer frame has one or more groove(s) for receiving marginal and peripheral edge portions of one or more inner sheet(s). The glazing units disclosed in U.S. Pat. No. '440 are acceptable because the gas movement between the compartments is minimized, if not eliminated; however, the glazing units have limitations. More particularly, positioning the spacer stock around the inner sheet(s) while moving the edge portions of the inner sheet(s) in the groove(s) of the sheet retaining members requires assembly time and precision.

United States Statutory Invention Regulation No. H975 (hereinafter "Publication H975"), published Nov. 5, 1991, discloses a multi-sheet unit having a pair of outer sheets spaced from one another by and secured to a spacer frame. An example of Publication H975 discloses the construction of the unit by mounting edge supports on the edge portions of an inner sheet and setting the inner sheet having the edge supports within the closed spacer frame. Thereafter, the edge supports are secured to the frame. The gas flow between the compartments as discussed in Publication H975 is controlled by the spaced distance between the edges of the inner glass sheet and the spacer frames. Although the design disclosed in Publication H975 is acceptable because gas flow between compartments is minimized, the construction of the unit has limitations. More particularly, mounting edge supports on the edges of an inner sheet and thereafter, securing the edge supports to the spacer frame is time consuming.

As can now be appreciated, it would be advantageous to provide multi-sheet glazing units, i.e. glazing units having three or more glass sheets that have minimal if any gas movement between compartments and do not have the limitations associated with presently available multi-sheet glazing units.

SUMMARY OF THE INVENTION

This invention relates to an improved multi-sheet glazing unit of the type having a closed e.g. closed ended spacer frame having an interior opening and an outer sheet adhered to each side of the spacer frame and an inner sheet mounted in the interior opening. The improvement includes the spacer frame having at least one side having a pair of outer legs and a base to provide the at least one side with a U-shaped cross section. The inner sheet has peripheral and marginal edge portions of one side inserted between the pair of legs and the remaining peripheral and marginal edge portions within the interior opening spaced from the spacer frame. Facilities mount the spacer frame for engaging selected remaining peripheral and marginal edge portions of the inner sheet to maintain the inner sheet in position between the interior opening of the spacer frame.

In one embodiment of the invention insulating gas is in the compartments between the inner sheet and ones of the outer sheets. The edge of the inner sheet between the outer legs ("bottom edge of the inner sheet") is mounted in an edge receiving member to restrict gas flow around the bottom edge of the inner sheet. More particularly, gas flow results from the gas being heated and rising to the top of the unit. The cool gas drops to the bottom of the unit. The rising of warm gas and dropping of cool gas results in gas flow around the bottom and top edges of the inner sheet. The gas flow between compartments is eliminated or minimized by reducing the distance between the peripheral edge of the inner sheet at the top and/or bottom of the inner sheet and the spacer frame. Mounting the bottom edge of the inner sheet between the outer legs of the spacer frame reduces the distance between the base of the spacer frame and the bottom edge of the inner sheet. The gas flow is in the vertical direction with minimal if any gas flow in the horizontal direction i.e. side to side.

In one embodiment of the invention, a moisture pervious adhesive having a desiccant is provided on the base of the spacer frame, and a pair of edge receiving members having a "⌒" cross-section are mounted on the outer legs of the spacer frame extending between the legs. The edge receiving member supports the bottom edge of the inner sheet to rest on or penetrate the adhesive to restrict gas flow around the bottom edge of the inner sheet.

The sides and top edges of the inner sheet are held in place in any convenient manner, for example by a sheet retaining or receiving members. In one embodiment of the invention, the sheet retaining member has a sheet engaging member having a vertical stop, a horizontal support and a securing or locking member securable on the horizontal support spaced from the vertical stop to form a groove for receiving edge portions of the inner sheet e.g. glass sheet.

In another embodiment, the sheet retaining member has a finger mounted on each side of a pair of opposite sides of a support member. The fingers are flexible for movement toward and away from the support member, and the ends of the fingers are spaced from one another to engage marginal edge portions of a sheet therebetween.

The invention further relates to a method of making a multi-sheet glazing unit. The method includes the step of providing a closed ended spacer frame having an interior opening and at least one side having a U-shaped cross section defined by a base and a pair of outer legs. An edge of an inner sheet is positioned between the legs and moved into the interior opening of the spacer frame. Thereafter, the edges of the inner sheet are secured to maintain the inner sheet within the interior opening. Outer sheets are secured to each side of the spacer frame to provide the multi-sheet glazing unit.

DESCRIPTION OF THE INVENTION

The various embodiments of the instant invention will be discussed in the construction of a thermally insulating multi-sheet glazing unit having a low thermal conducting edge determined as disclosed in the EP Application and U.S. Pat. No. '282 which disclosures are hereby incorporated by reference. As will be appreciated, the instant invention is not limited to a multi-sheet glazing unit that is thermally insulating and/or has a low thermal conductivity edge, and the embodiments of the present invention may be used with a multi-sheet glazing unit regardless of its thermal insulating properties, if any. In the following discussion, unless otherwise indicated, like numerals refer to like elements.

Figure 1:
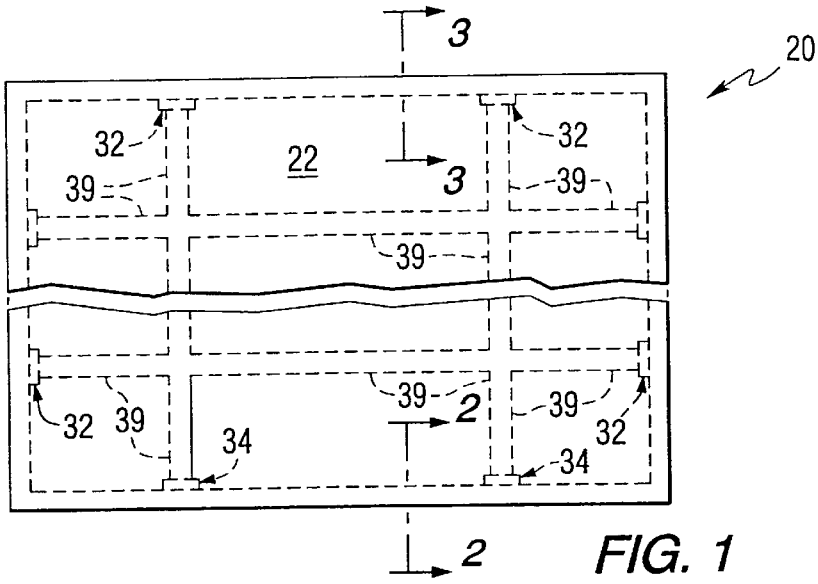
FIG. 1 is a front elevated view of a multi-sheet glazing unit incorporating features of the invention.
Figure 2:
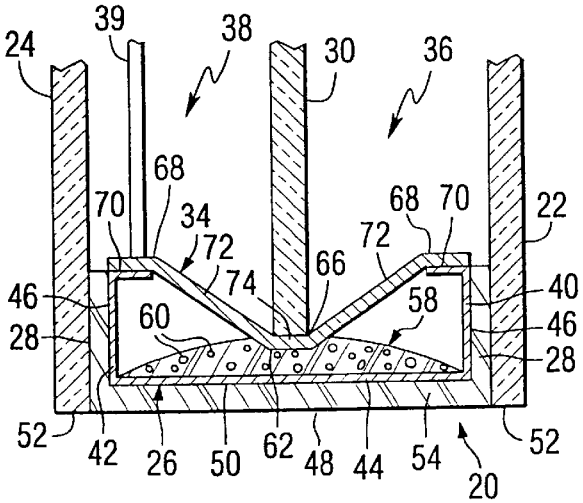
FIG. 2 is the view taken along lines 2—2 of FIG. 1.
Figure 3:
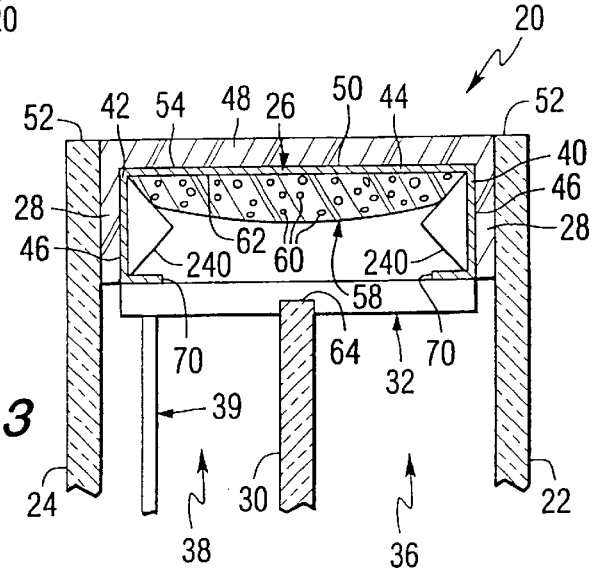
FIG. 3 is a view taken along lines 3—3 of FIG. 1.

FIG. 1 shows a multi-sheet glazing unit 20 incorporating features of the invention, and FIGS. 2 and 3 show cross-sectional views of the multi-sheet unit 20. With specific reference to FIG. 2, the unit 20 has a pair of outer sheets 22 and 24 secured to a spacer frame 26 by a layer 28 of an adhesive or moisture impervious adhesive sealant, and an inner or intermediate sheet 30 held in position between the outer sheets 22 and 24 at the side edges and top edge as viewed in FIGS. 1 and 3 by sheet engaging members 32. In FIG. 3 the sheet engaging member 32 is shown without specific design to indicate the sheet engaging members are not limiting to the invention. Preferred sheet engaging members are discussed in detail below. The bottom edge of the unit 20 as viewed in FIG. 1 has a pair of edge receiving members 34, only one shown in FIG. 2 and clearly shown in FIG. 4 incorporating features of the invention and discussed in more detail below. The sheet engaging members 32 and the edge receiving member 34 maintain the intermediate sheet 30 in position to provide a compartment 36 between the sheets 22 and 30, and a compartment 38 between the sheets 24 and 30. Preferably, but not limiting to the invention, the compartments 36 and 38 are sealed against the egress and ingress of the atmosphere outside the compartments, e.g., gases, moisture and/or dust (hereinafter individually and collectively referred to as "environmental atmosphere") by the layers 28 discussed in more detail below. Optionally muntin bars 39 discussed in more detail below are provided between the outer sheets 22 and 24, and as shown in FIG. 2 are mounted in the compartment 38.

In the following discussion, the sheets 22, 24 and 30 are glass sheets; however, as will become apparent, the sheets may be made of any material, e.g., glass, plastic, metal and/or wood, and the selection of the material of the sheets is not limiting to the invention. Further, the sheets may be made of the same material or the sheets may be made of different materials. Still further, one sheet may be a monolithic sheet, and the other sheet(s) may be laminated sheet(s), e.g., made of one or more monolithic sheets laminated together in any usual manner. One or more of the surfaces of one or more sheets may have an environmental coating to selectively pass predetermined wavelength ranges of light and energy, e.g., glass or plastic transparent sheets may have an opaque coating of the type used in making spandrels or the type of coatings disclosed in U.S. Pat. Nos. 4,170,460; 4,239,816; 4,462,884; 4,610,711; 4,692,389; 4,719,127; 4,806,220; 4,853,256, and 4,898,789, which disclosures are hereby incorporated by reference.

Further, in the practice of the invention, one or more of the glass sheets may be coated and/or uncoated colored sheets, e.g. but not limiting to the invention, colored sheets of the type disclosed in U.S. Pat. Nos. 4,873,206; 4,792,536; 5,030,593 and 5,240,886, which disclosures are hereby incorporated by reference. Still further, in the practice of the invention, the surfaces of the sheets may have a photocatalytic cleaning film or water reducing film, e.g., of the type disclosed in U.S. patent application Ser. No. 08/927,130 filed on Aug. 28, 1997, in the name of James P. Thiel for PHOTOELECTRICALLY-DESICCATING MULTIPLE-GLAZED WINDOW UNITS; U.S. patent application Ser. No. 08/899,257 filed on Jul. 23, 1997, in the names of Charles B. Greenberg et al., for PHOTOCATALYTICALLY-ACTIVATED SELF-CLEANING ARTICLE AND METHOD OF MAKING SAME, and U.S. patent application Ser. No. 60/040,566 filed on Mar. 14, 1997, in the names of Charles B. Greenberg et al., for PHOTOCATALYTICALLY-ACTIVATED SELF-CLEANING GLASS FLOAT RIBBON AND METHOD OF PRODUCING SAME, which disclosures are hereby incorporated by reference. The photocatalytic film disclosed in U.S. patent application Ser. No. 08/899,257 and No. 60/040,566 is preferably deposited on the outer surface of one or both sheets 22 and 24; however, the invention contemplates depositing the photocatalytic film on the inner surface of one or both sheets 22 and 24 and/or surfaces of the inner sheet 30. The water reducing film disclosed in U.S. patent application Ser. No. 08/927,130 is preferably deposited on one or more of the surfaces of the inner sheet(s) 30 or the inner surface of one or more of the outer sheets 22 and 24; however, the invention contemplates depositing the coating on the outer surface of one or both of the outer sheets 22 and 24.

The outer glass sheets 22 and 24 preferably have the same peripheral configuration and dimensions; however, as can be appreciated, one outer glass sheet may be larger than the other outer glass sheet. Further, one or more of the sheets 22, 24 and 30 may have different peripheral configurations than the remaining sheet(s).

With continued reference to FIGS. 2 and 3, and not limiting to the invention, the spacer frame 26 has a pair of spaced outer legs 40 and 42 secured to a base 44 to have a generally U-shaped configuration. The layer 28 is preferably a moisture-impervious material e.g. adhesive-sealant of the type used in the art of sealing compartments of insulating units. The layer 28 is provided on outer surface 46 of the legs 40 and 42 of the spacer frame 26 to secure the outer sheets 22 and 24 to the legs 40 and 42, respectively, to seal the compartments 36 and 38 against movement of environmental atmosphere into and out of the compartments. Although not limiting to the invention, the material for layers 28 preferably has a moisture permeability of less than about 20 grams millimeter (hereinafter "gm mm")/square meter (hereinafter "$M^{2}$") day, and more preferably less than about 5 gm mm/$M^2$ day, determined using the procedure of ASTM F 372–73. Materials that may be used in the practice of the invention include, but are not limited to, butyls, silicones, polyurethane adhesives, and butyl hot melts of the type sold by H. B. Fuller, e.g., H. B. Fuller 5140. Units filled with an insulating gas, e.g., argon, air, helium, etc. preferably have the adhesive-sealant layers 28 of a moisture and/or gas impervious material to maintain the insulating gas in the compartments 36 and 38.

It is preferred that the adhesive-sealant layer 28 be thin and long to reduce the diffusion of the insulating gas out of or the environmental atmosphere moving into the compartments of the unit as discussed in U.S. Pat. No. '282. The invention may be practiced with the adhesive-sealant layers 28 each having a thickness of about 0.005 inch (0.013 centimeter, hereinafter "cm") to about 0.125 inch (0.32 cm), preferably about 0.010 inch (0.025 cm) to about 0.020 inch (0.050 cm) and more preferably, about 0.015 inch (0.38 cm), and the layers 28 each having a length of about 0.010 inch (0.025 cm) to about 0.50 inch (1.27 cm), preferably about 0.125 inch (0.32 cm) to about 0.50 inch (1.27 cm) and more preferably about 0.200 inch (0.50 cm).

With respect to the loss of the insulating gas, e.g., argon, air, helium, etc. from the compartments 36 and 38, the thickness and length of the layers 28 are chosen in combination with the gas permeability of the adhesive-sealant layers 28 so that the rate of loss of the insulating gas matches the desired unit performance lifetime. Preferably, the rate of loss of the insulating gas should be less than about 5% per year and, more preferably, it should be less than about 1% per year determined as described in the EP Application and U.S. Pat. No. '282.

Figure 5:
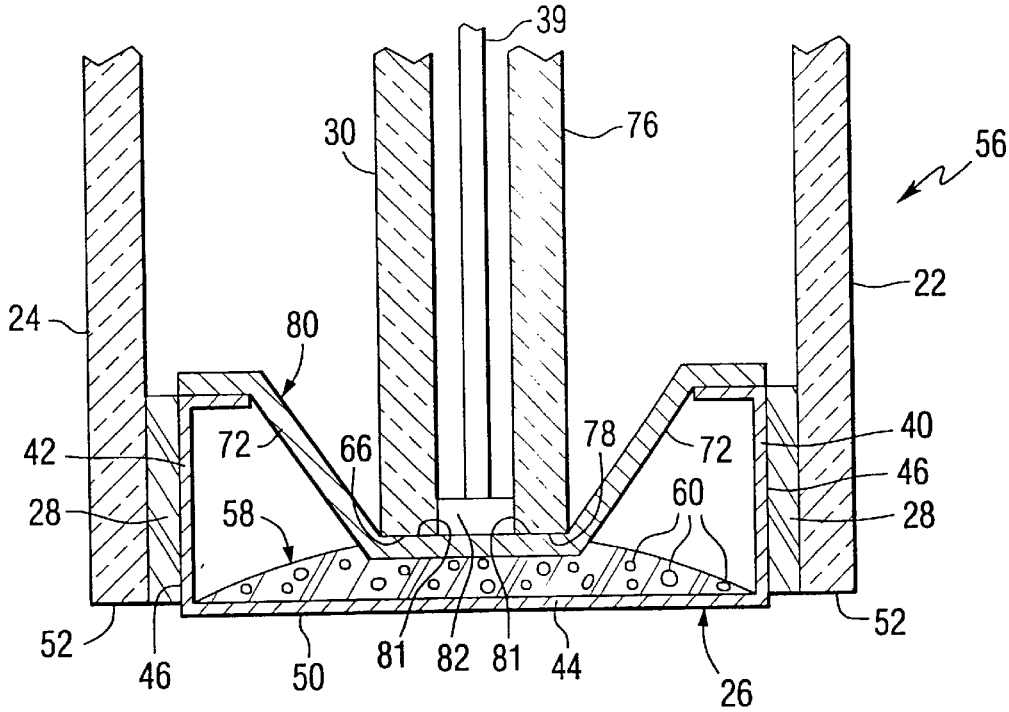
FIG. 5 is a view similar to the view in FIG. 2 illustrating an embodiment of the edge receiving member of the instant invention for a glazing unit having two inner sheets.

A layer 48 of an adhesive, sealant or adhesive-sealant may be provided on outer surface 50 of the base 44 of the spacer frame 26. The layer 48 may be a material similar or dissimilar to the material of the layers 28. It is preferred that the material of the layer 48 be non-tacky so that the peripheral edges of the multi-sheet unit 20 do not stick to surfaces supporting the edge of the unit. Further, in the practice of the invention, multi-sheet units having the layer 48, preferably have the outer surface 50 of the base 44 recessed inwardly from the peripheral edges 52 of the outer sheets 22 and 24 as viewed in FIGS. 2 and 3 to provide a channel 54 to receive the layer 48. The thickness of the layer 48 is not limiting to the invention, and the recommended thickness of the layer 48 is about 0.030 inch (0.08 cm) to about 0.50 inch (1.27 cm), preferably a thickness of about 0.150 inch (0.38 cm). The layer 48 preferably has similar moisture and gas permeability values as the layers 28. As can now be appreciated, the instant invention contemplates multi-sheet units without the peripheral channel 54 and layer 48 as shown in FIG. 5 for multi-sheet unit 56. The outer surface 50 of the base 44 of the spacer frame 26 for the unit 56 may extend beyond the peripheral edges 52 of the outer sheets 22 and 24 as shown in FIG. 5 or may be recessed as shown in FIG. 2, or may be in alignment with the peripheral edges 52 of the sheets 22 and 24.

The spacer frame 26 may be made of any material, e.g., wood, plastic, metal coated plastic, metal (e.g., stainless steel, galvanized steel or tin coated steel), or aluminum. Although the spacer frame may be made of any material, it is preferred that the spacer frame used in the practice of the instant invention have low thermal conductivity so that the spacer frame 26, the adhesive-sealant layers 28 and the layer 48, if present, collectively define an edge assembly that separates the outer sheets 22 and 24, and has a low thermal conductivity or high RES-value. Further, in the practice of the invention, it is preferred to use a spacer frame made of a material that is moisture and/or gas impervious e.g. but not limited to metal, e.g., stainless steel, halogenated polymeric material, and/or a gas-pervious material covered with an impervious film, e.g., metal or polyvinylidene chloride film.

The EP Application and U.S. Pat. No. '282 discuss in detail the concept of edge assemblies having low thermal conductivity and the determination of RES-value and reference may be made thereto for a detailed discussion.

Although the invention is not limited to the design construction of the spacer frame, it is preferred in the practice of the invention to use a close ended ("closed") spacer frame having an interior opening as shown by dotted lines in FIG. 1 and made from a continuous piece of spacer stock having a U-shaped cross-section as shown in FIGS. 2, 3 and 5. A detailed discussion of such a spacer frame is found in the disclosure of U.S. Pat. No. 5,177,916 (hereinafter "U.S. Pat. No. '916"). As can be appreciated, the invention is not limited to a spacer frame made from a continuous strip and the spacer frame may be made from sections of U-shaped spacer stock, e.g., of the type disclosed in the EP Application and U.S. Pat. No. '282 and joined together by corner keys or welding.

With continued reference to FIGS. 1–3 and 5, one or more bead(s) 58 of a moisture-pervious material having a desiccant 60 therein is provided on inner surface 62 of the base 44 of the spacer frame 26. Although the invention is not limited thereto, moisture-pervious materials having a permeability greater than about 2 gm mm/$M^2$ day as determined by the procedure set out in ASTM F 372–73 are recommended in the practice of the invention. Such materials are disclosed in the U.S. Pat. Nos. 5,177,916; 5,531,047 and 5,655,282, which patents are hereby incorporated by reference.

As can be appreciated, a water reducing film of the type disclosed in U.S. patent application Ser. No. 08/927,130 deposited on selected inner surfaces of outer sheets 22 and 24 and surfaces of intermediate or inner sheet 30 may be used to reduce the amount of desiccant required in the bead 58, or to eliminate the need for the desiccant 60 or the bead 58 of moisture pervious material having the desiccant 60.

The discussion will now be directed to the features of the instant invention to prevent gas currents moving along a vertical path around top edge 64 and bottom edge 66 of the intermediate sheet 30 (see FIGS. 2 and 3). In the following discussion unless indicated otherwise the top edge of the intermediate sheet 30 is at the top of the glazing unit, and the bottom edge of the intermediate sheet 30 is at the bottom of the glazing unit, as used. The movement of gas i.e. gas currents around the top and bottom edges 64 and 66, respectively, results from warm gas moving upward and cool gas moving downward. In the winter, the outer sheet of the glazing unit facing the house interior is heated, heating the gas in the compartment in contact with the heated outer sheet, and the outer sheet of the glazing unit facing the exterior of the house is cooled, cooling the gas in the compartment in contact with the cooled outer sheet. In the summertime, the outer sheet facing the exterior of the house is heated, and the outer sheet facing the interior of the house is cooled e.g. by air conditioning. There is minimal if any sideway movement of gas currents. To interrupt the gas flow or current, the flow around the top and/or bottom edge(s) of the intermediate sheet is(are) blocked or restricted. Gas flow may be restricted by minimizing the space between the bottom edge 66 or top edge 64 of the inner sheet 30 and the bead 58 is present or inner surface 62 of the base 44 if no bead 58 if present by, for example, having one of the edges e.g. the bottom edge 66 of the inner sheet 30 as shown in FIG. 2 in contact with the bead 58 of the moisture pervious material or resting on or closely adjacent to the inner surface 62 of the base 44.

Figure 4:
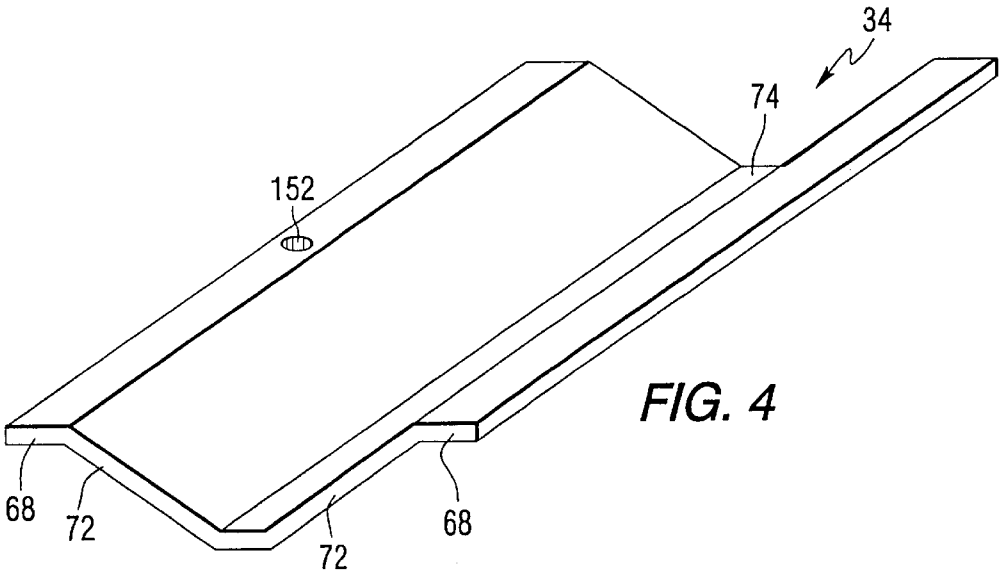
FIG. 4 is an isometric view of an edge receiving member incorporating features of the invention.

With reference to FIG. 2, in the practice of the invention, the edge receiving member 34 is mounted within the spacer frame 26 i.e. between the legs 40 and 42 of the spacer frame 26 at the bottom of the unit or at the top of the unit as the unit is used. In the preferred practice of the invention, two or more edge receiving members 34 are mounted between the legs 40 and 42 of the spacer frame 26 as shown in FIG. 2 at the bottom edge of the unit 20. With reference to FIGS. 2 and 4, the edge receiving member 34 has a generally "⌒" cross sectional configuration having a pair of horizontal members 68 that rest on horizontal extensions 70 of the outer legs 40 and 42 of the spacer frame 26 (shown in FIG. 2), downwardly sloping wall members 72 as viewed in FIG. 4 connected to and extending from the horizontal members 70, and a horizontal base 74 interconnecting the sloping wall members 72. The bottom edge 66 of the intermediate sheet 30 sets on the horizontal base 74.

The depth of the edge receiving member 34 i.e. the distance between the horizontal base 74 and the horizontal extensions 70 of the spacer frame 28 is selected such that the bottom surface of the horizontal base 74 as viewed in FIGS. 2 and 4 rests on or slightly moves into the bead 58 of the moisture pervious material when the horizontal members 68 of the edge receiving members 34 are seated on the horizontal extensions 70 of the legs 40 and 42 of the spacer frame 28. In this manner, the bottom edge 66 of the inner sheet 30 when positioned on the horizontal base 74 of the edge receiving member 3 contacts the bead 58 of moisture pervious material with minimal, if any, sinking of the bottom edge 66 of the inner sheet 30 into the bead 58. As can be appreciated, the invention is not limited to the position of the bottom edge 66 to the bead 58; however, sinking the edge 66 too far into the bead 58 may make it unsightly.

In order to position the inner sheet 30 into the edge receiving member after the spacer frame is formed, the inner sheet 30 is sized to fit within the interior opening of the closed spacer frame. More particularly, the distance between the sides of the inner sheet 30 should be less than the distance between the sides of interior opening of the closed spacer frame 26. The distance between the top edge 64 and bottom edge 66 of the inner sheet 30 is selected to permit setting of the bottom edge 66 or top edge 64, as the case may be, of the sheet 30 in the edge receiving member 34 and moving the other edge of inner sheet within the interior opening of the closed spacer frame.

As can be appreciated, the edge receiving member 34 may be a continuous piece extending across the bottom side or top side of the spacer frame or may be a plurality of spaced members as shown in FIG. 1. The invention is not limited to the length of the edge receiving member; however, if a continuous piece is not used at least two edge receiving members should be used to seat the inner sheet in the edge receiving members.

With reference to FIG. 5, the unit 56 has two inner or intermediate sheets 30 and 76 having their bottom edges 66 and 78 respectively, in edge receiving member 80. The edge receiving member 80 shown in FIG. 5 is similar to the edge receiving member 34 shown in FIG. 2 except that the edge receiving member 80 has two grooves formed by the downwardly sloping wall members 72 and intermediate member 82.

In the following discussion and not limiting to the invention the bottom edge 66 of the inner sheet 30 is mounted in the edge receiving member 34. The sides and top edge of the inner sheet 30 are held in position by sheet engaging members 32 (see FIGS. 1 and 3). As can be appreciated, instead of mounting the bottom edge 66 in the edge receiving member, the top edge of the inner sheet may be mounted in the edge receiving member, and the bottom edge of the inner sheet may be held in position by the sheet engaging members. Further, as can be appreciated, the sheet engaging members 32 are not limiting to the invention, and the following sheet engaging members are presented to illustrate types of sheet engaging members that may be used in the practice of the invention.

Figure 6:
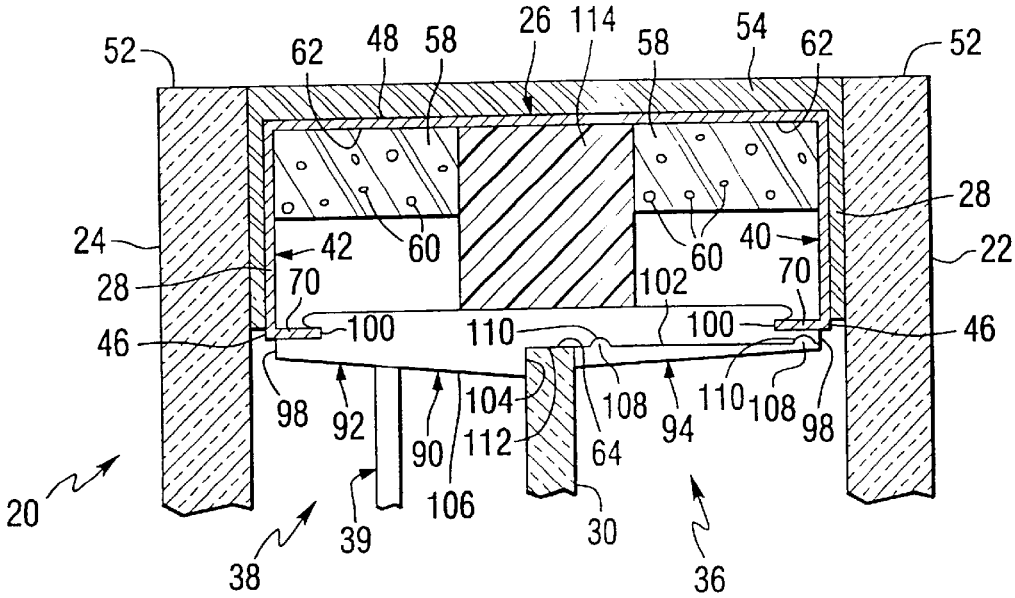
FIG. 6 is a view similar to the view of FIG. 3 illustrating one type of a sheet retaining member that may be used in the practice of the invention.
Figure 7:
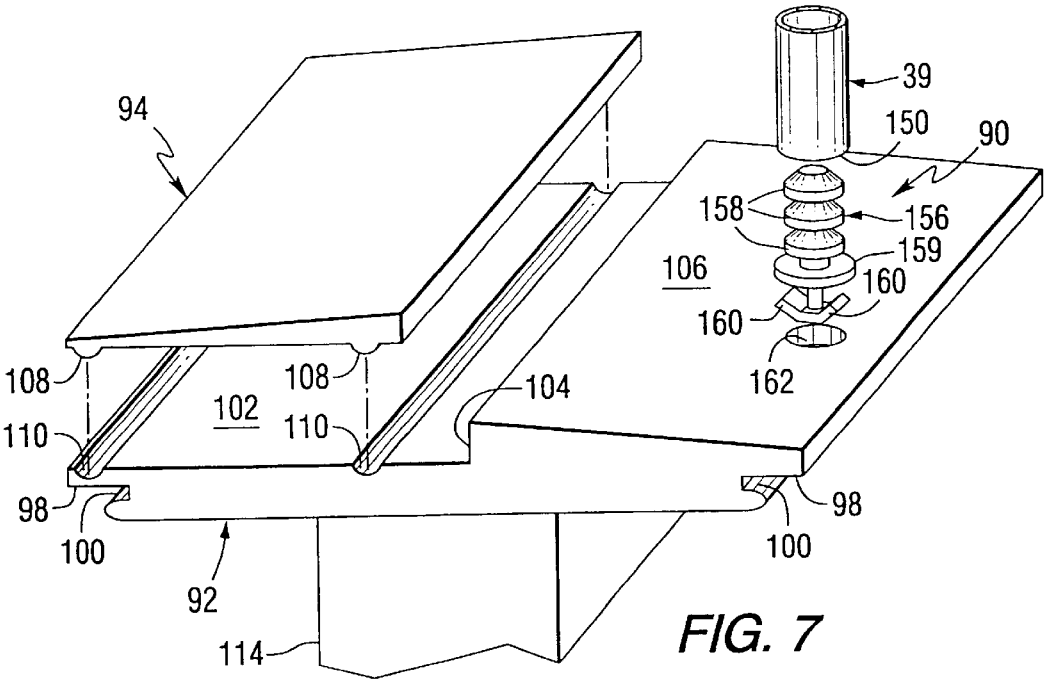
FIG. 7 is an isometric view of the sheet retaining member illustrated in cross-section in FIG. 6.

With reference to FIGS. 6 and 7, there is shown sheet engaging member 90 of the type disclosed in U.S. patent application Ser. No. 08/016,536 filed Jan. 30, 1998, in the name of Albert E. Thompson, Jr. for a "Multi-Sheet Glazing Unit Having A Single Spacer Frame And Method Of Making Same" (hereinafter "U.S. patent application Ser. No. 08/016,536"). The sheet retaining member 90 has a sheet engaging member 92 and a securing or locking member 94. The sheet engaging member 92 is captured in any usual manner between the legs 40 and 42 of the spacer frame 26 as shown in FIG. 6. More particularly, extensions 98 of the sheet engaging member 92 rest on horizontal extensions 70 of the legs 40 and 42. The end portion of the horizontal extensions 70 of the outer legs 40 and 42 are received in recess 100 provided on each side of the sheet engaging member 92. The sheet engaging portion 92 is sized and shaped such that moving the sheet retaining member 90 between the legs 40 and 42 of the spacer frame, moves the legs 40 and 42 apart to receive the sheet engaging member 92. Continued movement of the retaining member 90 between the legs 40 and 42 seats the extensions 98 of the sheet engaging member 92 on the horizontal extension 70 of the legs 40 and 42 and moves the end portions of the horizontal extensions 70 into the recesses or grooves 100 of the sheet engaging member 90.

With continued reference to FIGS. 6 and 7 and with particular reference to FIG. 7, the sheet engaging member 92 has a supporting surface 102, stop surface 104 and a sloped surface 106. The locking member 94 has a pair of protrusions 108 that are captured in grooves 110 in the supporting surface 102. When the locking member 94 is secured to the supporting surface 102 by inserting the protrusions 108 into the grooves 110, the locking member 94 and the stop surface 104 provide the sheet engaging member 92 with a sheet edge receiving recess 112 as shown in FIG. 6 for receiving edge portions of the inner sheet 30. More particularly, the sheet retaining members 90 at the side members and at the top member of the spacer frame and the edge receiving member at the bottom member secure the inner sheet 30 in position within the spacer frame between the outer sheets 22 and 24.

As can be appreciated, the locking member 94 may be secured to the supporting surface 102 to provide the sheet edge receiving recess 112 in any usual manner. For example, the locking member 94 may be secured to the supporting surface 102 by an adhesive, or by application of heat to fuse the pieces together, or by having one end of the locking member 94 pivotably mounted to the sheet engaging member and a protrusion at the other end of the locking member. In this manner the locking member 94 is pivoted toward the flat surface 102 and secured in position by the protrusion and groove combination.

Although not limiting to the invention it is preferred to have a support shim 114 as part of the sheet retaining member 90 as shown in FIGS. 6 and 7 to prevent the edge retaining member 90 from dropping between the legs 40 and 42 of the spacer frame 28. The support shim 114 may be made of any structurally stable material and is preferably made of plastic. As can be appreciated, the width of the shim is not limiting to the invention and may extend into contact with the legs 40 and 42 of the spacer frame 26.

Figure 9:
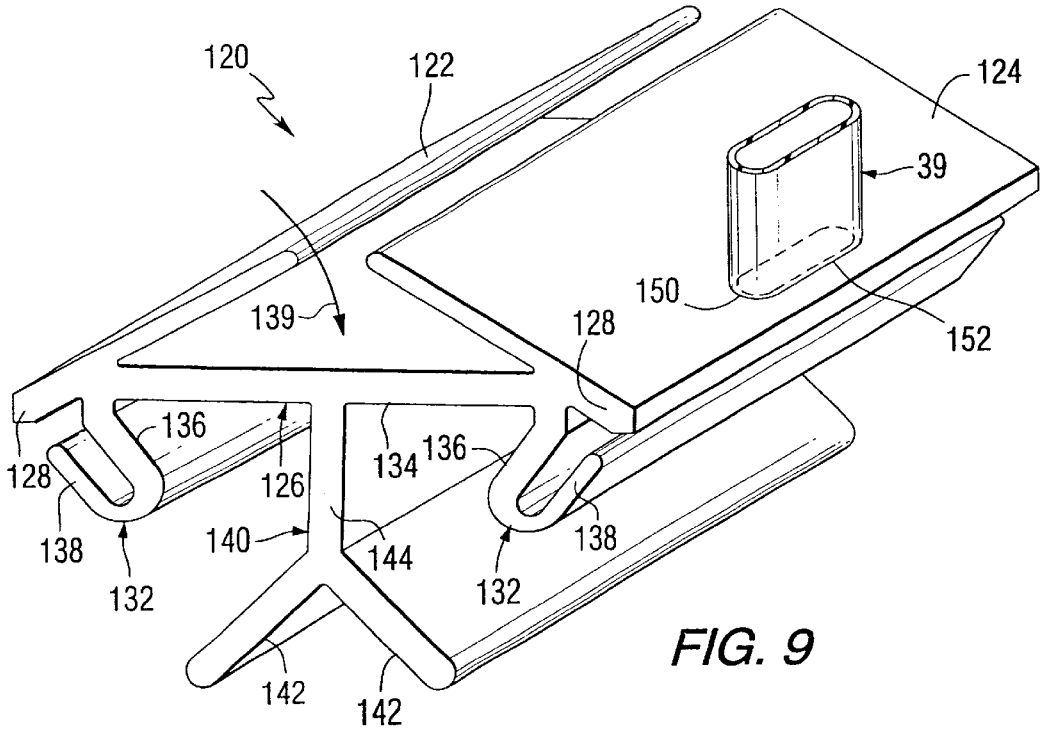
FIG. 9 is an isometric view of the sheet retaining member illustrated in cross-section in FIG. 8.
Figure 8:
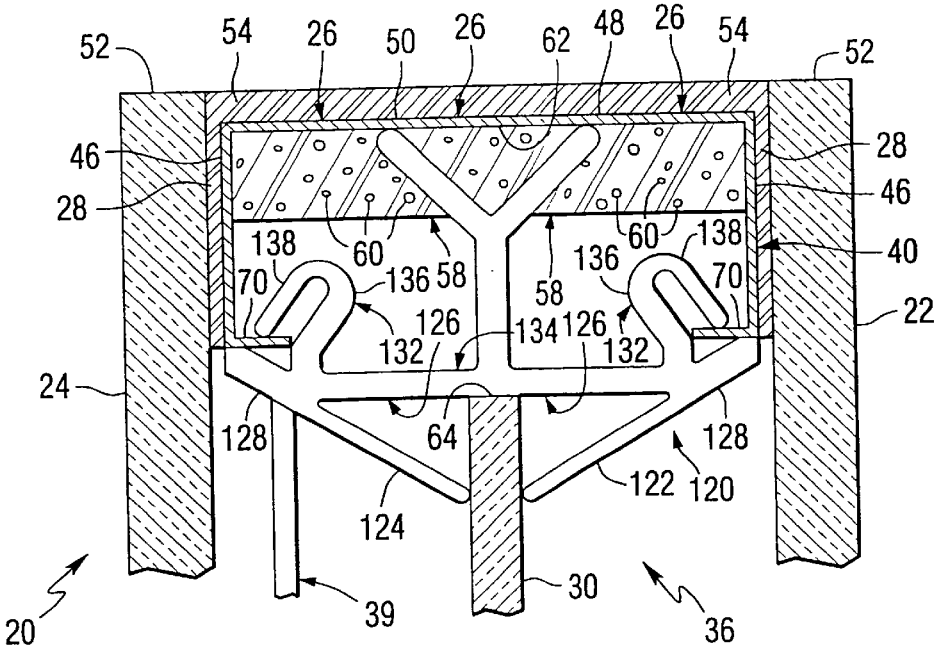
FIG. 8 is a view similar to the view of FIG. 3 illustrating another type of a sheet retaining member that may be used in the practice of the invention.

With reference to FIGS. 8 and 9, there is shown sheet retaining member 120 of the type disclosed in U.S. patent application Ser. No. 08/016,535 filed Jan. 30, 1998, in the name of Jack B. McCandless for a "Glazing Unit Having Three Or More Spaced Sheets And A Single Spacer Frame And Method Of Making Same" (hereinafter "U.S. patent application Ser. No. 08/016,535").

The sheet retaining member 120 has a plurality of fingers 122 and 124 mounted to support member 126 to engage and/or capture the edge portion inner sheet 30 therebetween in a manner to be discussed below. The support member 126 includes extensions 128 which rest on horizontal extensions 70 of the legs 40 and 42 of the spacer frame 26. The support member 126 has U-shaped member 132 attached to surface 134 of the support member 126, shown in FIG. 8 as the top surface and in FIG. 9 as the bottom surface. The U-shaped member includes a leg 136 attached to the surface 134 and a leg 138 more flexible than the legs 136. The support member 126, and legs 136 and 138 are sized and shaped such that moving the sheet retaining member 120 between horizontal extensions 70 of the legs 40 and 42 of the spacer frame 26, biases the leg 138 toward the leg 136. Continued movement of the sheet retaining member 120 between the legs 40 and 42 seats the extensions 128 of the sheet retaining member 120 on the horizontal extension 70 of the legs 40 and 42, and the horizontal extensions 70 of the legs 40 and 42 disengage the fingers 138 to capture the horizontal ends 70 of the legs 40 and 42 in the U-shaped member 132 to secure the sheet retaining member 120 on the spacer frame 26.

With continued reference to FIGS. 8 and 9, the fingers 122 and 124 are spaced from one another to hold edge portion of the inner sheet 30 therebetween. The inner sheet is mounted between the fingers 122 and 124 of the sheet retaining member 120 by moving the peripheral edge of the inner sheet 30 over one of the fingers e.g. the finger 122 of the sheet retaining members 120. As the edge of the sheet moves over the finger 122, the finger 122 moves toward the support member 126 in the direction of the arrowed lead line identified by numeral 139 in FIG. 9, the inner sheet is moved into contact with the end of the finger 124. Continued movement of the inner sheet 30 moves the finger 24 away from the support member 126 until the peripheral edge of the inner sheet clears the end of the finger 122. At that time the finger 122 moves upward as viewed in FIG. 9 to capture the edge portion of the inner sheet 30 between the fingers 122 and 124 as shown in FIG. 8.

Although not limiting to the invention, it is preferred to have a support shim as part of the sheet retaining member 120. The shim 114 shown in FIGS. 6 and 7 or shim 140 shown in FIGS. 8 and 9 may be used to prevent the edge retaining member 120 from dropping between the legs 40 and 42 of the spacer frame 28. The support shim 140 may be made of any structurally stable material and is preferably made of plastic. The support shim 140 has a Y shape as viewed in FIG. 8 with legs 142 resting on the base 44 of the spacer frame 26 and the leg 144 connected or in surface contact with surface 134 of the support member 126. As can be appreciated, the angle of the legs 142 is not limiting to the invention and may extend into contact with the legs 40 and 42 of the spacer frame. When the support shim 114 or 140 and the bead 58 having the desiccant 60 are used, the shim 114 or 140 may be supported on the inner surface 62 of the base 44 of the spacer frame 26 and the bead 58 may be provided on each side of the shim 114 or 140 or the shim 114 or 140 may be pushed into the bead 58 if it is sufficiently soft at room temperature. One type of moisture-pervious material that is soft at room temperature is PRC 525DM sold by Courtaulds Aerospace.

As can be appreciated, the invention is not limited to the material of the sheet retaining members 32, 90 and 120 used in the practice of the invention. For example, the sheet retaining members may be made of plastic, rubber, metal, wood, glass and/or reinforced plastic. In the practice of the invention it is preferred that the sheet retaining members be made of plastic because it is thermally non-conductive and economical to form. As can further be appreciated by those skilled in the art, the material of the sheet retaining member should be selected or prepared so that there is no outgassing of the material during use.

In the practice of the invention, the sheet retaining members 32, 90 and 120 may extend along the side members and top member of the spacer frame; however, it is preferred to use plurality of sheet retaining members on each side member and the top member of the spacer frame. For example, it is preferred that a sheet retaining member be used at the midpoint of each side and top member of the spacer frame when the member is less than about 2 feet (30 cm), at the quarter points when the member is more than about 2 feet (30 cm) and less than about 4 feet (60 cm), and about every 12 inches (30 cm) when the member is greater than about 4 feet (60 cm).

In the construction of multi-sheet glazing units, when muntin bars 30 are used, it is preferred to provide the muntin bars 39 between the outer sheets 22 and 24. With reference to FIGS. 1–9 as required, the muntin bars 39 are shown mounted in the edge receiving member(s) 34 of the invention (see FIG. 2) and 80 (see FIG. 5) and the sheet retaining members 90 (see FIGS. 6 and 7) and 120 (see FIGS. 8 and 9). The construction of muntin bars is well known to those skilled in the art of fabricating multi-sheet glazing units and is not limiting to the invention, therefore, a detailed discussion of the muntin bars is not deemed necessary and reference may be had to U.S. Pat. No. 5,313,761 to Glass Equipment Development Inc. and to U.S. Pat. No. 5,099,626 to Allmetal Inc., which disclosure is hereby incorporated by reference for a more detailed discussion of muntin bars.

The muntin bars 39 may be mounted to the edge receiving members 34 and 80 and the sheet retaining members 90 and 120 in any convenient manner. For example and with reference to FIGS. 7 and 9 and in particular FIG. 9, the end 150 of the muntin bar 39 is mounted and seated within a hole 152 provided in the extension 128 of the sheet retaining member 120. The hole 150 may extend through the extension 128 to rest on the horizontal extensions 70 of the outer legs 40 and 42 of the spacer frame 26. The hole 152 and end 150 of the muntin bar 39 are sized to have a pressure fit. A hole similar to the hole 152 is provided in the horizontal extension 70 of the edge receiving member 34 as shown in FIG. 4. With reference to FIG. 7, a muntin clip 156 may be used to secure the muntin bar 39 to the edge receiving members and the edge retaining members. The muntin clip 156 has a plurality of downwardly shaped ribs 158 which are mounted in the end 150 of the muntin bar 39. The muntin clip 156 has a base 159 having a periphery greater than the inside diameter of the end 150 of the muntin bar to prevent the muntin clip 156 from sliding into the end 150. On the other side of the base 159 are a pair of clips or "L" shaped legs 160 which are insertable into hole 162 in the sloped surface 106. The opening of the hole 162 at the sloping surface 106 is smaller than the spread of the clips 160. The spacing of the walls of the hole 162 under the sloping surface 106 is greater than the spread of the clips 160 to capture the muntin clip 156 on the sheet retaining member 90. The L-shaped legs 160 of the muntin clip 156 are biased toward one another as the legs 160 are moved into the hole 162. The legs 160 move away from one another as the base 159 is seated on the sloping surface 106 to capture the clip in the hole. The arrangement for mounting the muntins to the edge retaining member is preferably the same arrangement to mount the muntins to the edge receiving member at the horizontal members 68 (see FIG. 4) or the intermediate member 82 (see FIG. 5).

The invention will be discussed to make a glazing unit similar to the unit 20 having a closed spacer frame made from a continuous piece of spacer stock. Each of the outer sheets 22 and 24 are clear glass sheets having a length of about 42⅞ inches (108.9 centimeter, hereinafter "cm") and a width of about 19½ inches (49.53 cm). The inner sheet 30 is a clear glass sheet having a length of about 42³⁄₁₆ inches (106.68 cm) and a width of about 18½ inches (46.99 cm). The outer sheets have a thickness of 0.090 inch (0.229 cm), and the inner sheet has a thickness of about 0.070 inch (0.178 cm).

The surface of the glass sheets 22 and 24 designated to be the inner surfaces have a coating of the type sold by PPG Industries under its registered trademark Sungate® 100 coated glass. The designated outer surfaces have a photocatalytic cleaning film of the type disclosed in U.S. patent application Ser. Nos. 08/899,257 and/or 60/040,566. The surfaces of the inner sheet 32 have a water reducing film of the type disclosed in U.S. patent application Ser. No. 08/927,130.

Figure 10:
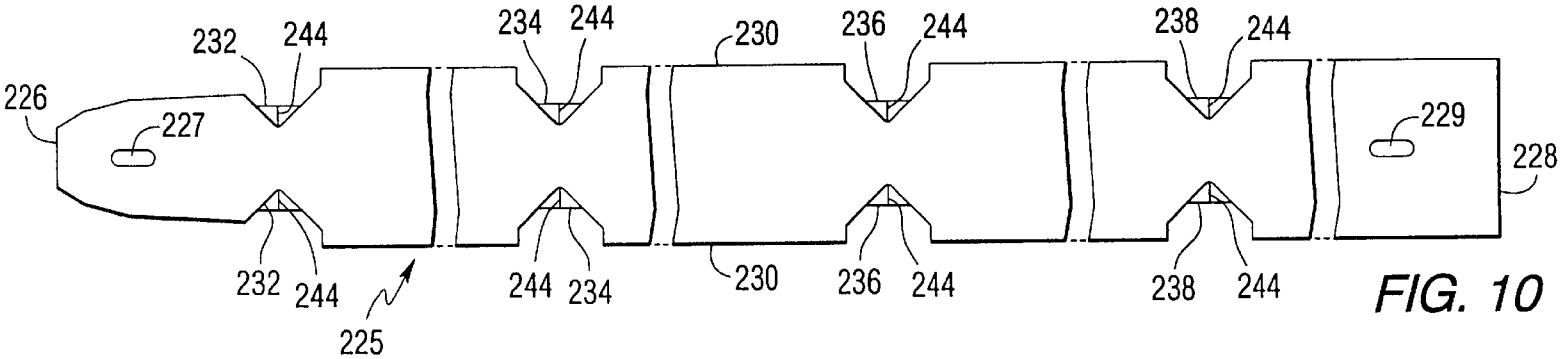
FIG. 10 is a plan view of a strip prior to shaping into a spacer stock having the U-shaped cross sectional configuration shown, among other places, in FIG. 2.

A closed spacer frame 28 having four continuous corners is made as follows. With reference to FIG. 10, a flat tin coated steel strip 225 having a length of about 126 inches (320 cm), a width of about 1.25 inches (3.18 cm) and thickness of about 0.010 inch (0.25 mm) is die cut. After die cutting, the strip 225 as shown in FIG. 10 has a tapered and wedged end 226 having a hole 227. Opposite end 228 of the strip 225 has a hole 229. Spaced at locations about 1.5 inches (3.8 cm), about 21⅛ inches (53.65 cm), about 63⅞ inches (162.24 cm), and about 83½ inches (212.09 cm) from the end 226, material is removed from opposite edge portions 230 of the substrate 225 to provide sets of paired notches 232, 234, 236 and 238 respectively. The notched areas form the bent portions 240 (see FIG. 3), and the notches provide for the bent portions 240 to be a sufficient distance so as not to overlap and to eliminate the horizontal extension 70 of the legs 40 and 42 at the corners of the spacer frame for ease of bending the subsequently formed spacer stock to provide the closed spacer frame. Crease lines 244 are provided at the notches as shown in FIG. 10 for ease of bending the subsequently formed spacer stock to provide the closed spacer frame. A spacer frame having continuous corners is disclosed in detail in U.S. Pat. Nos. '047 and '916 which disclosures are hereby incorporated by reference.

Each of the notches of the set of paired notches 234, 236 and 238 have a length of about 0.536 inch (1.36 cm) at the edge 230 of the substrate, a depth of about 0.170 inch (0.43 cm) as measured from the edge 230 of the substrate toward the center of the substrate. The notches 232 are similar in size as the notches 234, 236 and 238 but the left side of the notch as shown in FIG. 10 is further cut to insert the end 226 into the end 228 after the strip 225 is formed into the spacer stock having a U-shaped cross section. The distance between the points of pairs of notches depends on the width of the base of the spacer frame, i.e., the desired spacing between the outer sheets. The unit has the point of the crease lines spaced about 0.500 inch (1.27 cm) from the edge 230 of the substrate to provide the base with a width of about 0.50 inch (1.27 cm) and ends 88 having an extension of about 0.078 inch (0.18 cm).

The strip 225 is shaped to provide a spacer stock having a U-shaped cross section as shown in FIGS. 2, 3, 5, 6 and 8. Ends 230 of the substrate 225 are bent over to form the horizontal extensions 70 of the outer legs 40 and 42 to provide the spacer frame with structure stability, and to secure the edge receiving members and sheet retaining members in position as discussed above. The layers 28 and 48 of the adhesive-sealant are provided on the outer surfaces 46 of the legs 42 and 44 and outer surface 50 of the base 44 of the spacer frame 28.

A bead 58 of H. B. Fuller HL 5102X-125 butyl hot melt matrix having the desiccant 60 is flowed on the inner surface 62 of the base 44 of the spacer frame 28 in any usual manner. Thereafter the spacer stock is bent to form a closed spacer frame. A rivet or screw (not shown) may be used to secure the ends 226 and 228 together, e.g. after the compartments are filled with insulating gas.

With reference to FIG. 4, two edge receiving members 34 are provided, each member 34 has a thickness of about 0.031 inch (0.079 cm), a length of about ⅜ inch (0.925 cm) and is made of polyurethane. Each of the horizontal members 68 have a width of 0.079 inch (0.20 cm) and the horizontal base 74 has a width of about 0.076 inch (0.19 cm). The sloping members have a width of 0.118 inch (0.30 cm) and a slope of about 36.5 degrees. One of the horizontal legs has a hole 152 for receiving the L-shaped legs 160 of the muntin clip 156. The edge receiving clips 32 are mounted at the quarter points on the bottom member of the spacer frame.

With reference to FIG. 7, six sheet retaining members 90 made of plastic are provided. Each of the sheet retaining members 90 have the sheet engaging member 92 having a width of about 0.490 inch (2.0 cm) as measured between the ends of the extension 98 and a length of about 0.5 inch (1.27 cm). The recesses 100 have a depth of 0.012 inch (0.030 cm) at the side measured from the end of the extension 90 and a depth at the other side of about 0.006 inch (0.015 cm) to provide the underside of the sheet engaging member 92 as viewed in FIG. 7 with a width of about 0.475 (1.9 cm) to move the underside between the legs 40 and 42 of the spacer frame. The extensions 98 have a height of about 0.022 inch (0.005 cm). The supporting surface 102 has a length of about 0.263 inch (0.67 cm). The sloping surface 106 has a width of about 0.208 inch (0.52 cm). The locking member 94, the protrusions 108 and the grooves 110 are sized to lock the locking member 94 in position by inserting protrusions 108 into the grooves 110 on the supporting surface 102. A hole 162 is provided in the sloping surface 106 of each of the sheet retaining members as shown in FIG. 7 to receive the L-shaped legs 160 of the muntin clip 39. The support shim 114 is made of plastic and has a height of about 0.206 inch (0.52 cm), a length of about 0.5 inch (1.27 cm) and a depth of about 0.20 inch (0.51 cm). The shim 114 is set in positioned between the legs 40 and 42 is the quarter point of the side and top members of the spacer frame in the bead 58 and the sheet retaining member 90 is positioned at the quarter points on top of the shims 114 as previously discussed.

The muntin clips 39 are mounted in the ends 150 of the muntin bars formed in a lattice as shown by dotted lines in FIG. 1 in any usual manner, and the muntin clips are mounted in the holes 162 in the edge receiving members 32 and the holes 162 of the sheet retaining members 90 to position the muntin bars within the interior opening of the closed spacer frame. The outer sheet 24 is thereafter positioned on the adhesive layer 28 on the outer surface of the outer leg 40 of the spacer frame 26. The bottom edge 66 of the inner sheet 30 is positioned on the horizontal base 74 of the sheet receiving member 32 and pivoted into the interior opening of the closed spacer frame to move the sides and top edge 64 of the inner sheet against the vertical stop 104 (see FIGS. 6 and 7). Thereafter, the locking member 94 is snapped in position by inserting the protrusions 108 into the grooves 110. Thereafter, the designated inner surface of the outer sheet 22 is adhered to the leg 40 of the spacer frame 26 by the layer 28 of the adhesive-sealant.

The outer glass sheets 22 and 24 are biased toward one another to flow the adhesive-sealant layer 28 to secure the outer glass sheets to the spacer frame.

The discussion will now be directed to fabricating the unit 20 using the sheet retaining members 120 shown in FIGS. 8 and 9. The closed spacer frame having the edge receiving members 32 is prepared as previously discussed. In this instance the edge receiving member 74 (see FIG. 4) has a hole 152 similar to the 152 in the extension 128 shown in FIG. 9 for receiving an end of the muntin bar. Six sheet retaining members 90 made of plastic are provided. The support member 126 of the sheet retaining member 120 has a width of about 0.656 inch (1.7 cm) as measured between the ends of the extension 128 and a length of about 0.5 inch (1.27 cm). The distance between the fingers 122 and 124 in the unbiased position e.g. the position as shown in FIGS. 8 and 9 is about 0.070 inch (0.178 cm). The fingers have a thickness of about 0.020 inch (0.508 cm) and the support member 126 has a thickness of about 0.035 inch (0.076 cm). The legs of the shim 140 each have a thickness of about 0.035 inch (0.076 cm). The angle subtended by the fingers 122 and 124 in the unbiased position and the upper surfaces of the support member is about 30°. The horizontal distance from the end of the fingers 122 or 124 to the extension 128 as measured in the unbiased position is about 0.293 inch (0.75 cm). A hole 152 is provided in each of the sheet retaining members on one side of the fingers for receiving end 150 of the muntin bar 39. The hole 152 and ends 150 of the muntin bars 39 are sized to provide a pressure fit to secure the ends of the muntin bars in the edge receiving member 32 and sheet retaining member 120. A sheet retaining member 120 is mounted to the spacer frame as previously discussed at the quarter points on the top member and side members of the closed spacer frame.

The ends 150 of the muntin bars 39 formed into the lattice as shown by dotted lines in FIG. 1 are mounted in the holes 152 of the edge receiving members 32 and the sheet retention members 120. Thereafter, the bottom edge 66 of the inner sheet 30 is positioned on the horizontal base 74 and the inner glass sheet moved into the interior opening of the closed spacer frame 26 into engagement with the finger 122, into the interior opening biasing the finger 122 toward the support platform 126 in the direction of the arrow 139. The sheet 32 is further moved toward the finger 124 and into engagement with the finger 124. Continued movement of the inner sheet 30 moves the finger 124 to the left as viewed in FIG. 9 until the peripheral side and top edges of the inner sheet 30 clears the end of the finger 122. After the edges of the inner sheet 30 clear the finger 122, the finger 122 moves to the unbiased position as shown in FIGS. 8 and 9. The inner sheet 30 is now captured between the fingers 122 and 124. If the muntin bar lattice was not previously mounted, it may now be mounted in the holes 152 in the edge receiving member 32 and sheet retaining members 120.

The designated inner surfaces of the sheets 22 and 24 are adhered to the legs 40 and 42 of the spacer frame 26 by the layer 28 of the adhesive-sealant. The outer glass sheets 22 and 24 are now biased toward one another to flow the adhesive-sealant layer 28 to secure the outer glass sheets to the spacer frame.

In the previous examples, if the layer 48 of the adhesive-sealant was not provided on the outer surface 50 of the base 44 of the spacer frame 26, the layer 48 of the adhesive-sealant is flowed into the channel 54 formed by the marginal edge portions of the sheets 22 and 24 and the outer surface 50 of the base 44 of the spacer frame 26.

As can be appreciated, the bead 58 having the desiccant 60 may be extruded before, after, or during the extrusion of the layers 28. Further, the layer 48 may be applied to the outer surface 50 of the base 44 during or after the strip is formed into spacer stock. Further, as now can be appreciated, the invention is not limited to the sequence of steps to make the unit. For example, and not limiting to the invention, after the closed spacer frame having the bead 58 is provided, the sheet receiving members 34 are mounted on the closed frame. Thereafter the inner sheet 30 is secured in position as previously discussed, and the layers 28 and sheets 22 and 24 are mounted on the legs 40 and 42 respectively of the closed spacer frame 26.

Figure 11:
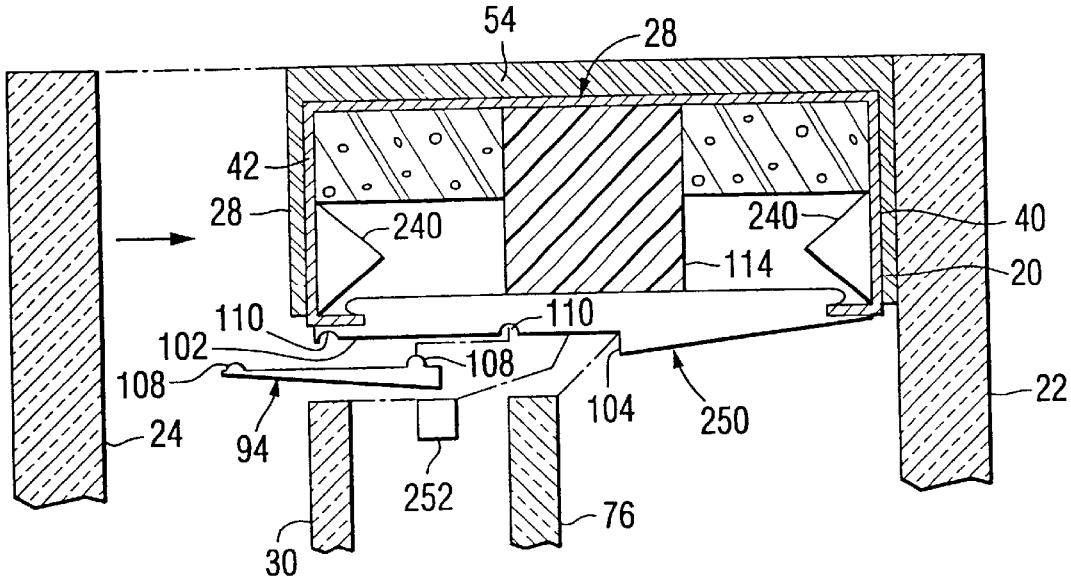
FIG. 11 is a view similar to the view of FIG. 6 showing selected steps practiced in the fabrication of a multi sheet glazing unit of the instant invention having two inner sheets.

As can now be appreciated, the invention is not limited to the number of inner sheets. For example, and with reference to FIG. 11, there is a sheet retaining member 250 that may be used with the edge receiving member 80 to provide a glazing unit having four sheets. The sheet retaining member 250 is similar to the sheet retaining member 90 shown in FIG. 7 except the sheet retaining member 250 is wider to support two inner sheets. The sheet retaining member 250 has supporting surface 102 and stop surface 104. The inner sheet 76 is mounted in the groove 81 of the sheet receiving member 80 and pivoted into the interior opening of the closed spacer frame against the stop surface 104 of the sheet retaining member 250. Thereafter, a separator 252 is secured to the support surface 102 against peripheral edges of the inner sheet 76 in any usual manner e.g. by adhesive. Thereafter, the bottom edge of the inner sheet 30 is positioned in the other groove 81 and pivoted into the interior opening of the closed spacer frame against the separator 252. The locking member 94 is mounted on the support surface 102. The outer sheets are secured to the legs of the spacer frame as previously discussed.

Figure 12:
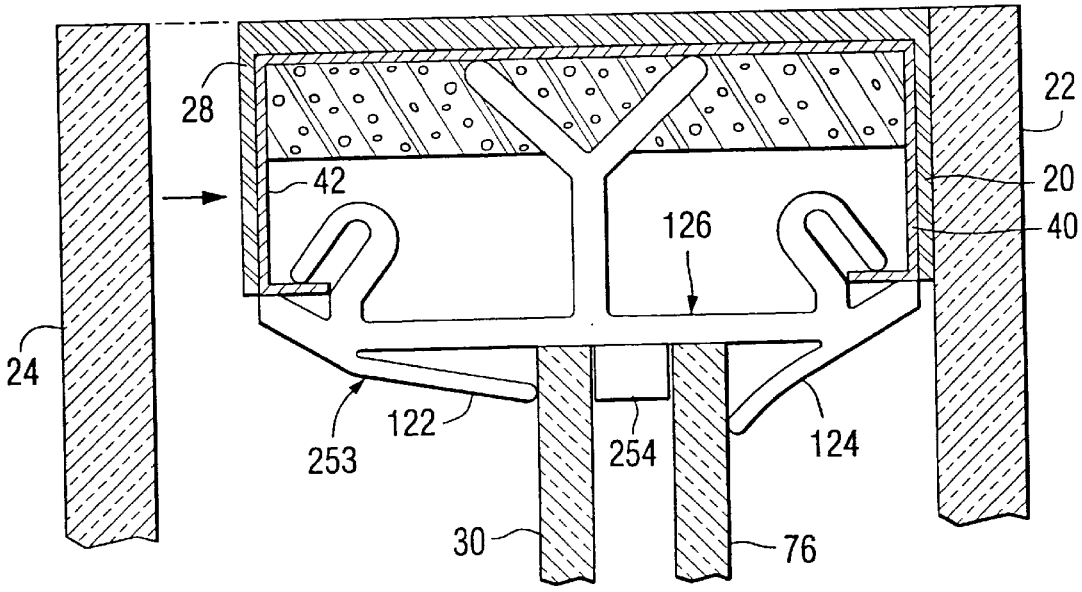
FIG. 12 is a view similar to the view of FIG. 8 showing selected steps practiced in the fabrication of a multi sheet glazing unit of the instant invention having two inner sheets.

FIG. 12 shows the sheet receiving member 253 used in the construction of a unit having four sheets. The sheet 76 is mounted in a similar manner as the sheet 30 was mounted in the sheet retaining member 120 (see FIG. 9) for triple glazed unit. After the inner sheet 76 is mounted between the fingers 122 and 124, the separator 254 is positioned against the edges of the inner sheet 76 on the support member 126. The inner sheet 30 is mounted in the edge receiving member 80 as previously discussed and moved into the interior of the closed spacer frame against the finger 122 until it is captured between the fingers 122 and 124. Thereafter the outer sheets 22 and 24 are secured to the spacer frame as previously discussed. The separator 254 should be held in position and moveable while mounting the inner sheet 30 between the fingers 122 and 124. This may be accomplished by slideably capturing the separator 254 on the support member 126 in a usual manner.

In the instance when muntin bars are used, the separator 252 of the sheet retaining member 250 and/or the separator 254 of the sheet retaining member 253 may be mounted on the ends of the muntin bars and the separators positioned against the marginal edge of the inner sheet 76. Thereafter the other inner sheet e.g. the inner sheet 30 is secured on the sheet retaining member 250 or 253 as previously discussed.

Figure 13:
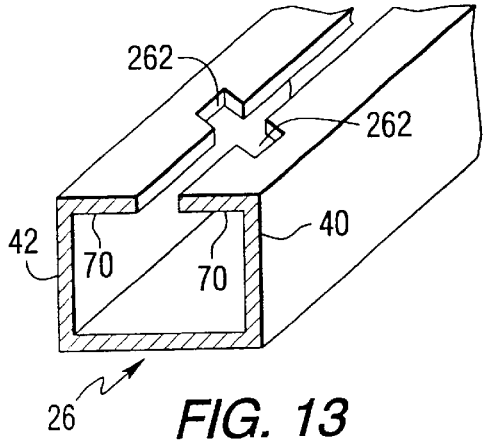
FIG. 13 is a partial isometric view of a spacer frame having cutouts for receiving the edge receiving member and sheet retaining member of the instant invention.

As can now be appreciated, the invention is not limited to the embodiments of the glazing units or the components used in the fabrication of the units discussed above, and additional embodiments can be made within the scope of the invention. For example, and with reference to FIG. 13, the horizontal extensions 70 of the legs 40 and 42 of the spacer frame 26 may have cutouts 262 to secure the edge receiving members 32 and 80 and sheet retaining members 90, 120, 250 and 253 on the spacer frame and for specifying location of the edge receiving members sheet retaining members. Further U.S. patent application Ser. Nos. 08/016,536 and 08/016,535 each disclose additional embodiments of sheet retaining members that may be used in the practice of the invention.

As previously mentioned, it is recommended that two edge receiving members be used to balance the inner sheet. Two sheet retaining members should be used at each side and top member of the closed frame for a balanced appearance. In the instance where the muntin lattice has only one leg, three edge receiving members and three sheet retaining members are used to support the muntin lattice.

Figure 14:
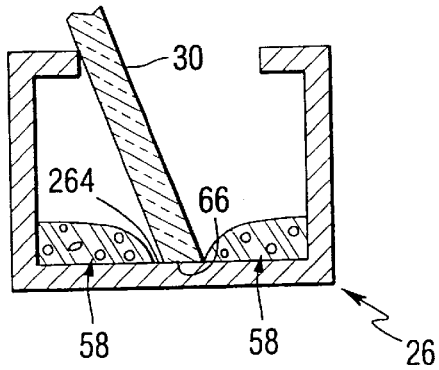
FIG. 14 is a cross sectional side view illustrating another method of practicing the invention to mount an inner sheet within a closed spacer frame.

In the preferred embodiment of the invention, an edge receiving member having features of the invention was used; however, the invention may be practiced without an edge receiving member and prevent gas flow around the top and bottom edges of the inner sheet as used. More particularly, and with reference to FIG. 14, the bottom member of spacer frame 26 has a groove 264 formed by a pair of beads 58 as disclosed in U.S. Pat. No. 5,531,047. The edge retention recess 112 of the sheet retaining member 90 (see FIG. 6) and the spacing between the ends of the fingers 122 and 124 of the sheet retention member 120 (see FIG. 9) are aligned with the groove 264. The bottom edge 66 of the inner sheet is positioned in the groove 264 and the inner sheet 30 pivoted into the interior opening of the closed spacer frame to capture the sides and top edge of the inner sheet in the edge retention members as previously discussed. Further, the sheet retaining member of U.S. Pat. No. 5,553,440 and the spacer frame having raised portions on the base as disclosed in U.S. Pat. No. 5,644,894 may be used to hold the bottom edge of the inner sheet(s) in position between the outer legs 40 and 42 of the spacer frame 26.

As can now be appreciated, the scope of the invention is only limited by the scope of the following claims.

What is claimed is:

1. An article comprising:

a support platform comprising;

a first major surface, a major surface opposite the first major surface defined as a second major surface;

a groove on the first major surface for receiving marginal and peripheral edge portions of a sheet, and a first side between the first and second major surfaces and a side opposite to the first side defined as a second side between the first and second major surfaces;

a support member between the first and second sides of the platform and extending away from the second major surface of the platform;

"a pair of engaging members, one engaging member adjacent the first side, the other engaging member adjacent the second sides, of the" platform, and a cavity or post for receiving an end portion of a muntin bar.

2. The article of claim 1 wherein each of the engaging members are grooves in surface portions of the first and second pair of sides.

3. An article comprising:

a support platform comprising;

a first major surface, a major surface opposite the first major surface defined as a second major surface;

a groove on the first major surface for receiving marginal and peripheral edge portions of a sheet, and a first side between the first and second major surfaces and a side opposite to the first side defined as a second side between the first and second major surfaces;

a support member between the first and second sides of the platform and extending away from the second major surface of the platform;

a pair of spaced locating tabs mounting the platform support, and a cavity or post for receiving an end portion of a muntin bar.

4. The article of claim 3 wherein the pair of spaced locating tabs are on the second surface and one of the tabs defined as the first tab is adjacent the first side of the platform and the other one of the tabs defined as the second tab is adjacent the second side of the platform.

5. The article of claim 2 wherein each of the grooves has a first wall portion adjacent the first major surface, a wall portion spaced from the first wall portion defined as a second wall portion adjacent the second major surface and a recess between the first and second wall portions wherein the first wall portion adjacent the first major surface has a height as measured from bottom of the recess greater than the height of the second wall portion measured from the bottom of the recess.

6. The article of claim 5 wherein the groove on the first major surface for receiving the marginal and peripheral edge portions of a sheet comprises a vertical stop on the first major surface of the support platform and a retention member securable on the first major surface of the platform spaced from the vertical stop to form the groove on the first major surface for receiving the marginal and peripheral edge portions.

7. The article of claim 6 wherein the support member comprises a solid elongated member.

8. An article comprising:

a support platform member comprising;

a first major surface, a major surface opposite the first major surface defined as a second major surface;

a groove on the first major surface for receiving marginal and peripheral edge portions of a sheet, and a first side between the first and second major surfaces and a side opposite to the first side defined as a second side between the first and second major surfaces;

a support member between the first and second sides of the platform and extending away from the second major surface of the platform;

engaging member adjacent the first and the second sides of the platform wherein each of the engaging members are grooves in surface portions of the first and second pair of sides, a cavity or post for receiving an end portion of a muntin bar, and wherein the first major surface has a length as measured between the first and second sides greater than the length of the second major surface as measured between the first and second sides to provide a first extension at the first side and an extension at the second side defined as a second extension wherein the engaging member at the first side comprises the first extension and a flexible member, and the engaging member at the second side comprises the second extension and a flexible member wherein each of the flexible members comprises a "U" shaped member having a leg of the "U" shaped member mounted to the second major surface and other leg of the "U" shaped member adjacent to and spaced from its respective one of the first and second extensions.

9. The article of claim 8 wherein the groove on the first major surface for receiving the marginal and peripheral edge portions of a sheet comprises a pair of fingers, each finger having a first side and an opposite side designated as a second side with the second side of one finger mounted on the first major surface adjacent the first side of the support platform and the second side of the other finger mounted on the first major surface adjacent the second side of the support platform with the fingers extending above the first major surface of the support platform toward one another, the first side of each of the fingers bendable and the fingers in an unbiased position spaced from the first major surface of the support platform with the second side of each finger in a fixed relationship to one another.

10. The article of claim 9 wherein the support member comprises three leg members, each leg member having first end and an opposite end defined as a second end wherein the first end of each of the three leg members are mounted together and the second end of one of the three leg members is mounted to the second major surface between the first and second sides.

11. The article of claim 1 wherein the support member comprises a solid elongated member.

12. An article comprising:

a support platform comprising;

a first major surface, a major surface opposite the first major surface defined as a second major surface;

a groove on the first major surface for receiving marginal and peripheral edge portions of a sheet, and a first side between the first and second major surfaces and a side opposite to the first side defined as a second side between the first and second major surfaces;

a support member between the first and second sides of the platform and extending away from the second major surface of the platform wherein the support member comprises three leg members, each leg member having first end and an opposite end defined as a second end wherein the first end of each of the three leg members are mounted together and the second end of one of the three leg members is mounted to the second major surface between the first and second sides;

engaging member adjacent the first and the second sides of the platform, and a cavity or post for receiving an end portion of a muntin bar.

13. An article comprising:

a support platform comprising;

a first major surface, a major surface opposite the first major surface defined as a second major surface;

a groove on the first major surface for receiving marginal and peripheral edge portions of a sheet;

a first side between the first and second major surfaces and a side opposite to the first side defined as a second side between the first and second major surfaces, and a recess in the first side and a recess in the second side wherein each of the recesses has a first wall portion adjacent the first major surface, a wall portion at the second major surface defined as a second wall portion, the second wall portion spaced from the first wall portion and a recess between the first and second wall portions wherein the first wall portion has a height as measured from bottom of the recess greater than the height of the second wall portion measured from the bottom of the recess;

a support member between the first and second sides of the platform and extending away from the second major surface of the platform;

a pair of spaced locating tabs mounting the platform support wherein one of the tabs defined as the first tab is adjacent the first side of the platform and the other one of the tabs defined as the second tab is adjacent the second side of the platform and the second wall portion at the first side is the first tab and the second wall portion at the second side is the second tab, and a cavity or post for receiving an end portion of a muntin bar.

14. The article of claim 13 wherein the groove on the first major surface for receiving the marginal and peripheral edge portions of a sheet comprises a vertical stop on the first major surface of the support platform and a retention member securable on the first major surface of the platform spaced from the vertical stop to form the groove on the first major surface for receiving the marginal and peripheral edge portions.

15. The article of claim 14 wherein the support member comprises a solid elongated member.

16. An article comprising:

a support platform comprising;

a first major surface, a major surface opposite the first major surface defined as a second major surface;

a groove on the first major surface for receiving marginal and peripheral edge portions of a sheet, and a first side between the first and second major surfaces and a side opposite to the first side defined as a second side between the first and second major surfaces wherein the first major surface has a length as measured between the first and second sides greater than the length of the second major surface as measured between the first and second sides to provide an extension at the first and second sides;

a support member between the first and second sides of the platform and extending away from the second major surface of the platform;

a pair of spaced locating tabs mounting the platform support wherein the pair of spaced locating tabs are on the second surface and one of the tabs defined as the first tab is adjacent the first side of the platform and the other one of the tabs defined as the second tab is adjacent the second side of the platform wherein the tab at the first side and at the second side each comprises a flexible member wherein each of the flexible members comprises a "U" shaped member having a leg of the "U" shaped member mounted to the second major surface and other leg of the "U" shaped member adjacent to and spaced from its respective one of the first and second extensions, and a cavity or post for receiving an end portion of a muntin bar.

17. The article of claim 16 wherein the groove on the first major surface for receiving the marginal and peripheral edge portions of a sheet comprises a pair of fingers, each finger having a first side and an opposite side designated as a second side with the first side of one finger mounted on the first major surface adjacent the first side of the support platform and the first side of the other finger mounted on the first major surface adjacent the second side of the support platform with the fingers extending above the first major surface of the support platform toward one another, the first side of each of the fingers bendable and the fingers in an unbiased position spaced from the first major surface of the support platform with the second side of each finger in a fixed relationship to one another.

18. The article of claim 17 wherein the support member comprises three leg members, each leg member having first end and an opposite end defined as a second end wherein the first end of each of the three leg members are mounted together and the second end of one of the three leg members is mounted to the second major surface between the first and second sides.

19. The article of claim 4 wherein the support member comprises a solid elongated member.

20. An article comprising:

a support platform comprising;

a first major surface, a major surface opposite the first major surface defined as a second major surface;

a groove on the first major surface for receiving marginal and peripheral edge portions of a sheet, and a first side between the first and second major surfaces and a side opposite to the first side defined as a second side between the first and second major surfaces;

a support member between the first and second sides of the platform and extending away from the second major surface of the platform wherein the support member comprises three leg members, each leg member having first end and an opposite end defined as a second end wherein the first end of each of the three leg members are mounted together and the second end of one of the three leg members is mounted to the second major surface between the first and second sides;

a pair of spaced locating tabs mounting the platform support wherein the pair of spaced locating tabs are on the second surface and one of the tabs defined as the first tab is adjacent the first side of the platform and the other one of the tabs defined as the second tab is adjacent the second side of the platform, and a cavity or post for receiving an end portion of a muntin bar.

* * * * *